US008534279B2

(12) United States Patent
Brace et al.

(10) Patent No.: US 8,534,279 B2
(45) Date of Patent: Sep. 17, 2013

(54) RESPIRATOR SYSTEM INCLUDING CONVERTIBLE HEAD COVERING MEMBER

(75) Inventors: Thomas J. Brace, St. Paul, MN (US); Alex Davies, Austin, TX (US); Alan J. Solyntjes, Edina, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 339 days.

(21) Appl. No.: 12/934,288

(22) PCT Filed: Mar. 2, 2009

(86) PCT No.: PCT/US2009/035629

§ 371 (c)(1), (2), (4) Date: Sep. 24, 2010

(87) PCT Pub. No.: WO2009/123809

PCT Pub. Date: Oct. 8, 2009

(65) Prior Publication Data

US 2011/0048416 A1 Mar. 3, 2011

Related U.S. Application Data

(60) Provisional application No. 61/042,304, filed on Apr. 4, 2008.

(51) Int. Cl.
*A62B 18/00* (2006.01)
*A42B 3/00* (2006.01)

(52) U.S. Cl.
USPC ..... 128/201.24; 128/201.15; 128/201.22; 128/201.23; 2/5

(58) Field of Classification Search
USPC ..... 128/201.15, 201.29, 202.11, 201.22–25; 2/5, 6.1–6.4, 6.6, 6.8, 7–8, 410–411
See application file for complete search history.

(56) References Cited

U.S. PATENT DOCUMENTS

| | | | | |
|---|---|---|---|---|
| D250,496 | S | 12/1978 | Odell et al. | |
| 4,280,491 | A * | 7/1981 | Berg et al. | 128/201.24 |
| 4,752,974 | A | 6/1988 | Haino | |
| 4,817,596 | A * | 4/1989 | Gallet | 128/201.24 |
| 4,995,117 | A * | 2/1991 | Mirage | 2/410 |
| 5,533,500 | A * | 7/1996 | Her-Mou | 128/201.25 |
| 5,577,495 | A | 11/1996 | Murphy | |
| D420,771 | S | 2/2000 | Burns | |
| 6,035,451 | A | 3/2000 | Burns et al. | |
| 6,102,033 | A | 8/2000 | Baribeau et al. | |
| D443,394 | S | 6/2001 | Martin et al. | |
| D444,269 | S | 6/2001 | Jeffreys | |
| 6,279,572 | B1 * | 8/2001 | Danisch et al. | 128/201.25 |

(Continued)

FOREIGN PATENT DOCUMENTS

| | | |
|---|---|---|
| JP | 62-180462 | 11/1987 |
| JP | 5-168724 | 7/1993 |

(Continued)

*Primary Examiner* — Justine Yu
*Assistant Examiner* — Timothy Stanis

(57) ABSTRACT

A headgear article includes a head covering member that has an opening formed therein. A panel is disposed over the opening and is removably attached to the head covering member. A respirator system is also disclosed that includes the headgear article and further including a visor and defining an interior zone. The respirator system also includes a clean air supply system having an inlet configured for connection to a source of clean air and an outlet disposed within the interior zone.

18 Claims, 6 Drawing Sheets

(56) References Cited

U.S. PATENT DOCUMENTS

| | | | | |
|---|---|---|---|---|
| 6,298,498 | B1 | 10/2001 | Burns et al. | |
| 6,332,228 | B1 | 12/2001 | Takahara | |
| D453,056 | S | 1/2002 | Garneau | |
| 6,418,564 | B1 | 7/2002 | Sheridan | |
| D485,947 | S | 1/2004 | Pelletier et al. | |
| D499,214 | S | 11/2004 | Cheng | |
| D503,497 | S | 3/2005 | Canavan et al. | |
| D503,498 | S | 3/2005 | Canavan et al. | |
| 6,859,946 | B2 * | 3/2005 | Fournier et al. | 2/424 |
| D504,195 | S | 4/2005 | Canavan et al. | |
| D511,227 | S | 11/2005 | Canavan et al. | |
| D511,865 | S | 11/2005 | Canavan et al. | |
| D512,187 | S | 11/2005 | Canavan et al. | |
| 6,961,963 | B2 | 11/2005 | Rosie | |
| 6,973,676 | B1 * | 12/2005 | Simpson | 2/171.3 |
| D517,745 | S | 3/2006 | Lee et al. | |
| 7,007,306 | B2 | 3/2006 | Howard et al. | |
| D520,684 | S | 5/2006 | Martin et al. | |
| D539,485 | S | 3/2007 | Huh et al. | |
| D590,547 | S | 4/2009 | Brace et al. | |
| 2004/0064873 | A1 * | 4/2004 | Muskovitz | 2/410 |
| 2004/0182385 | A1 | 9/2004 | Uusitalo et al. | |
| 2006/0026741 | A1 * | 2/2006 | Lang-Ree et al. | 2/410 |
| 2006/0107431 | A1 * | 5/2006 | Curran et al. | 2/7 |

FOREIGN PATENT DOCUMENTS

| | | | |
|---|---|---|---|
| JP | 11-124719 | A2 | 5/1999 |
| JP | 2002004127 | | 1/2002 |
| KR | 10-0431116 | B1 | 5/2004 |
| WO | WO 2006005184 | A1 * | 1/2006 |

* cited by examiner

RESPIRATOR SYSTEM INCLUDING CONVERTIBLE HEAD COVERING MEMBER

CROSS REFERENCE TO RELATED APPLICATIONS

This application is a national stage filing under 35 U.S.C. 371 of PCT/US2009/035629, filed Mar. 2, 2009, which claims priority to U.S. Provisional Application No. 61/042,304, filed Apr. 4, 2008, the disclosure of which is incorporated by reference in its/their entirety herein.

BACKGROUND

The present disclosure is related generally to a respirator system including a convertible head covering member. The present disclosure is also related to headgear articles including convertible head covering members, which are suitable for use in respirator systems.

Respirator systems are often used to aid a user's breathing in an environment containing dusts, fumes, vapors, and/or gases. The respirator systems may be configured to filter the air or they may provide a supply of uncontaminated air. In a supplied air respirator system, clean air may be forced into the interior gas space from an air supply tank or from a powered air source that drives ambient air through an air filter, usually by means of a hose. A respirator system may in some cases include a helmet, hardhat or a similar head covering device for impact resistance. Respirator systems that include impact resistant head covers are frequently worn by people working in areas where there is a potential for impact from a foreign object. A visor or face shield is often included in the respirator system and may have any suitable configuration to provide appropriate amount of substantially unrestricted vision for the user of the surrounding environment. When the respirator system is in use with the face shield lowered, the system should inhibit passage of contaminants, both particulate and gaseous, into the wearer's air space. Many face shields are pivotally attached to the head covering member to allow the face shield to be lifted when it is not needed. Common respirator systems are mounted on a user's head by means of a head suspension system attached to the interior of the head covering device.

Generally, it is desired that a respirator system, and, particularly the head covering device, be comfortable to wear for extended periods of time in variable conditions.

SUMMARY

Thus, there is a need for respirator systems including head covering members that can be modified depending on the working conditions to suit the wearer's needs.

In one implementation, the present disclosure is directed to a respirator system including a headgear article defining an interior zone. The headgear article includes a visor and a head covering member. The head covering member has a first opening formed therein that provides fluid communication between the interior zone and environment outside the headgear article. A first panel is disposed over the first opening and is removably attached to the head covering member. The respirator system further includes a clean air supply system having an inlet configured for connection to a source of clean air and an outlet disposed within the interior zone.

In another implementation, the present disclosure is directed to a respirator system including a headgear article defining an interior zone. The headgear article includes a visor and a head covering member. The head covering member has first and second openings formed therein that provide fluid communication between the interior zone and environment outside the headgear article. A first panel is disposed over the first opening and is removably attached to the head covering member, and a second panel is disposed over the second opening and is removably attached to the head covering member. The respirator system further includes an air duct disposed between the first and second openings, the duct having an inlet configured for connection to a source of clean air and an outlet disposed within the interior zone.

In yet another implementation, the present disclosure is directed to a headgear article including a head covering member having an opening formed therein. A panel having an outer surface is disposed such that a substantial portion of the outer surface is disposed over the opening. The panel includes at least one retaining member configured to removably attach to the edge of the opening.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

In the following description, reference is made to the accompanying drawings that form a part hereof, and in which are shown by way of illustration several specific embodiments. It is to be understood that other embodiments are contemplated and may be made without departing from the scope or spirit of the present invention. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Exemplary embodiments of the present disclosure provide one or more openings in the headgear article, which may be useful for ventilation. According to the present disclosure, the one or more openings can be covered by one or more panels, which removably attach to the headgear article. The removability of the one or more panels allows the user of the headgear article the flexibility to remove or install them when desired. By adding impact-resistant material to the panels, the impact resistance of the headgear article may be enhanced. The removable panels may be provided with colored layers, patterns, images and/or reflective materials.

Figure 1A:
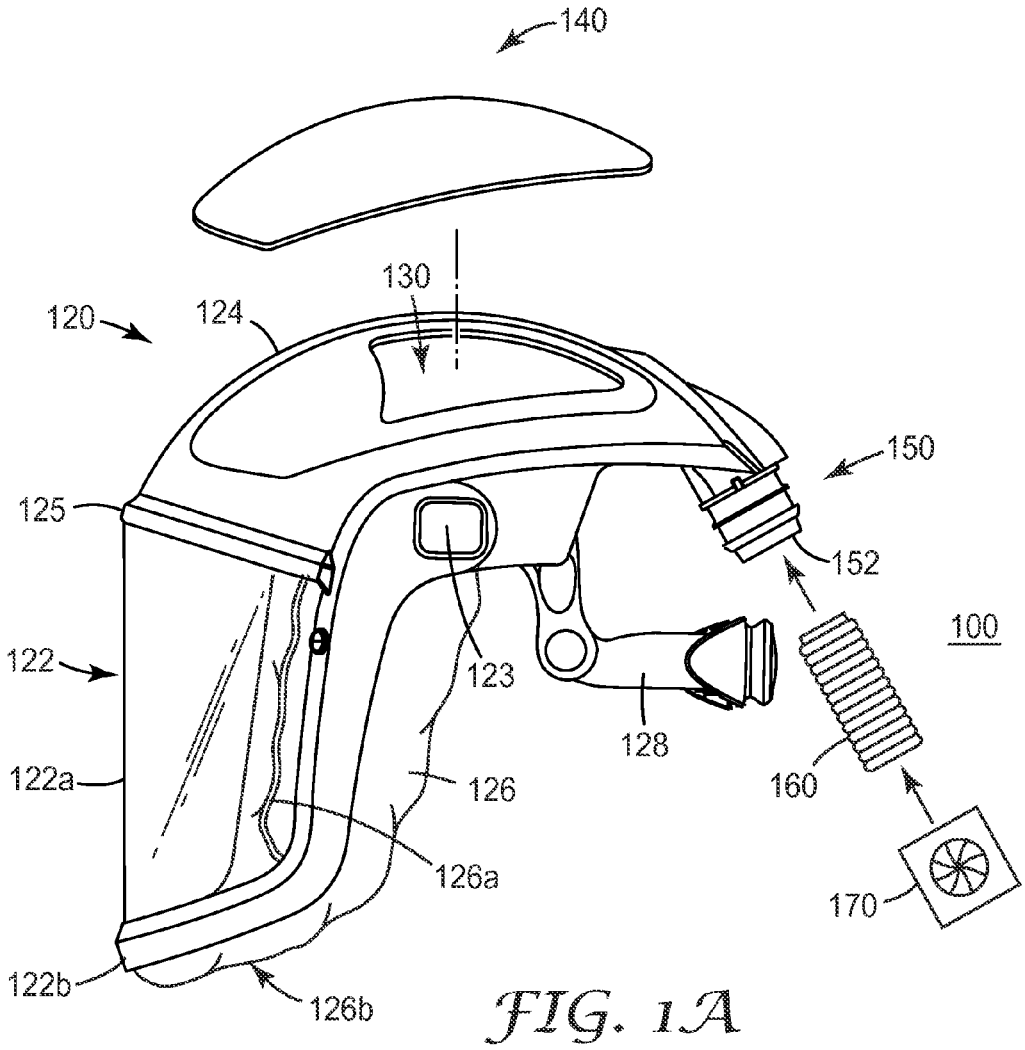
FIG. 1A shows schematically a perspective view of an exemplary embodiment of a respirator system according to the present disclosure with its visor in a lowered position.
Figure 1B:
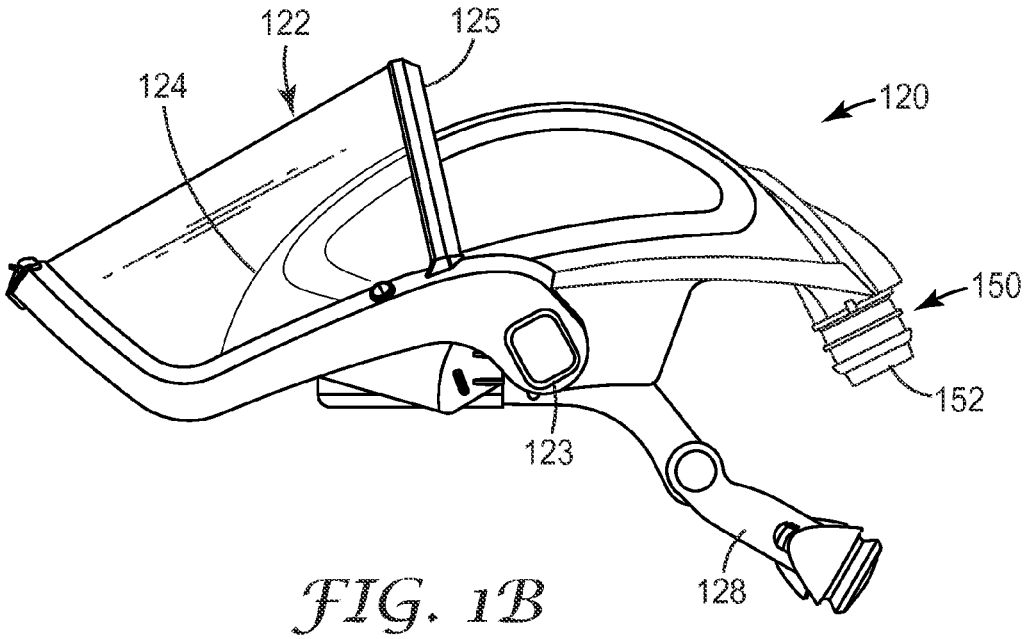
FIG. 1B shows schematically a side view of the exemplary respirator system shown in FIG. 1A with its visor in a raised position.
Figure 1C:
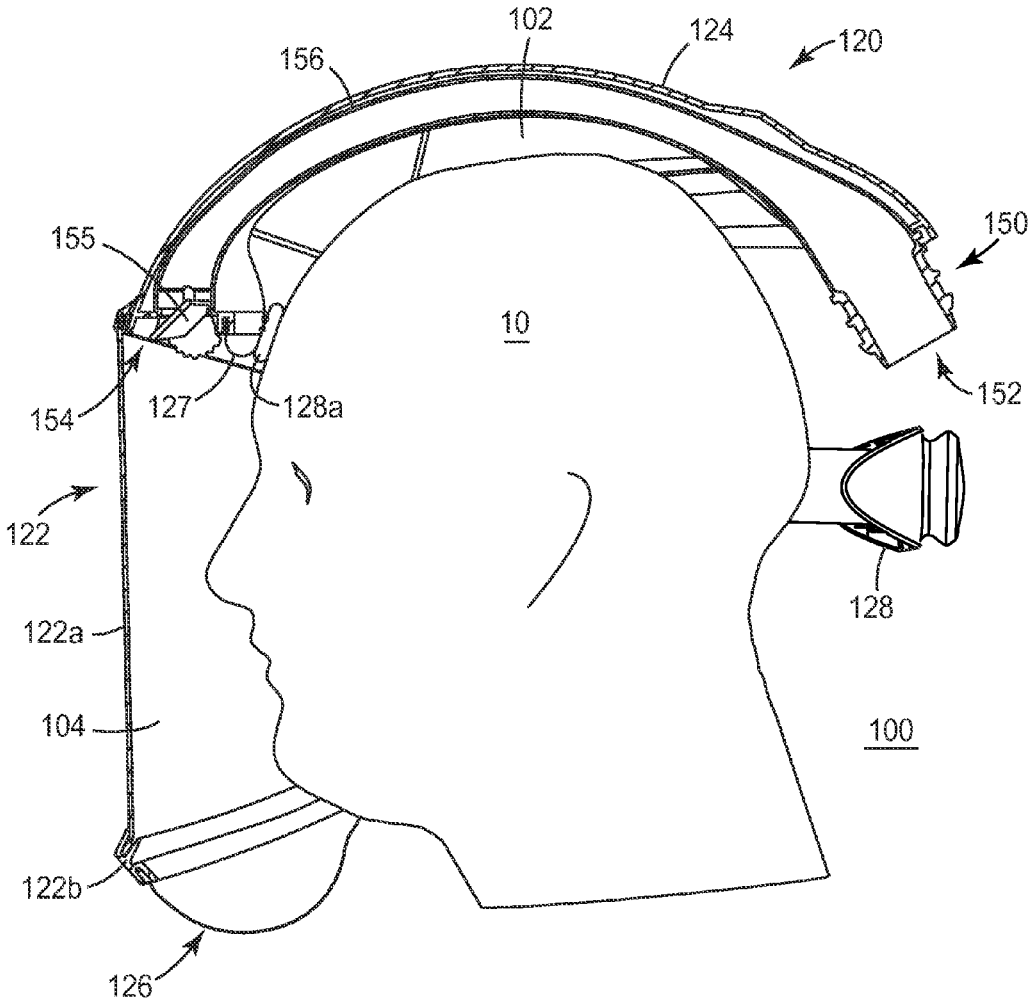
FIG. 1C shows schematically a cross-sectional side view of the exemplary respirator system shown in FIG. 1A disposed on a user's head.

An exemplary embodiment of a respirator system 100 according to the present disclosure is illustrated in FIGS. 1A, 1B and 1C. The respirator system 100 includes a headgear article 120, which includes a visor 122 and a head covering member 124. Preferably, the visor 122 is pivotally attached to the head covering member 124 via pivot mechanism 123, such that the visor may have a lowered position (FIG. 1A), a raised position (FIG. 1B) and various intermediate positions. Any suitable pivoting mechanism is within the scope of the present disclosure.

The visor 122 includes a transparent member, which may be made of any suitable transparent material, such as a plastic material. In an exemplary embodiment, the visor 122 includes a generally curved lens 122*a* and a lens frame 122*b*. Lens frame 122*b* supports lens 122*a* and facilitates pivoting of the visor 122 via pivot mechanism 123. The curved lens 122*a* may be characterized by a cylindrical curvature with a spherical or an elliptical cross-section. The visor 122 includes a seal 125 attached to the lens 122*a*, the lens frame 122*b* or both. Seal 125 typically engages frontal area of the head covering member 124, when visor 122 is in its lowered or closed position (FIG. 1A). In some embodiments, the seal may be fluid tight, e.g., air tight.

The head covering member 124 typically includes an outer shell that has sufficient structural integrity to retain its desired shape (and the shape of other layers that are supported by it) under normal handling. Preferably, the head covering member 124 includes a shape-retaining outer shell, which substantially retains its shape after any deforming forces have ceased. In exemplary embodiments providing at least some impact protection to a user of the headgear article 120, the head covering member 124 is configured to resist impact. For the purposes of the present disclosure, impact resistance exists where the head covering member absorbs at least a certain amount of mechanical energy from impact that would otherwise reach a user's head. Exemplary materials suitable for use in a head covering member include, without limitation, high density polyethylene, polypropylene, nylon, polycarbonate, ABS, styrene. Aluminum, fiber reinforced plastics, laminated paper products could also be used.

In accordance with the present disclosure, the head covering member 124 has at least one opening 130 formed therein. The opening 130 is configured to provide fluid communication between an interior zone 102 (shown in FIG. 1C), defined by the headgear article 120 and a user's head 10, and environment outside the headgear article. A layer of filter material may be disposed in the opening such that it separates the interior zone 102 from the environment outside the headgear article 120. The layer of filter material would typically include one or more layers of material, which layer(s) is adapted for the primary purpose of removing contaminants (such as particles) from an air stream that passes through it, while allowing the passage of hot, moist air from above the wearer's head into the outside environment. A panel 140 is configured such that it can be disposed over the first opening and removably attached to the head covering member 124, as described in more detail below in connection with FIGS. 2A-3B. Exemplary embodiments of the present disclosure may include two or more openings, such as 130, and panels, such as 140, configured to be removably attached thereto. One, two or more removable panels may include an impact resistant material.

Referring further to FIG. 1C, the headgear article 120 of the respirator system 100 also may define a breathing zone 104 in the interior thereof as a subsection of the interior zone 102. The breathing zone 104 is located between the visor 122 and the wearer's face. In the exemplary embodiment shown in FIG. 1C, the breathing zone 104 is also defined by the face seal 126. A breathing zone seal 127 may be used to separate the breathing zone 104 from the remainder of the interior zone 102. In the illustrated embodiment, the remainder of the interior zone 102 resides between the head covering member 124 and the top of the user's head.

Clean air can be provided into the breathing zone 104 from any suitable source of clean air. The wearer breathes the air and exhales it back into the breathing zone. This exhaled air, along with excess clean air that is forced into the breathing zone, may exit the breathing zone through openings or through any other suitable route. For the purposes of the present disclosure, "clean air" means atmospheric ambient air that has been filtered or air supplied from an independent source. "Clean air source" means an apparatus, such as a filtering unit, compressed air source or a tank, that is capable of providing a supply of clean, breathable air for the user of the respirator system.

Referring further to FIGS. 1A and 1C, the headgear article 120 may also include a face seal 126 and a suspension system 128. The suspension system 128 serves to mount and support the headgear article 120 on a user's head, and it may be adjustable and typically includes a headband 128*a* configured to be disposed across a user's forehead. The face seal 126 is typically configured as to engage a wearer's face and aid in separating the breathing zone 104 from the outside environment. The face seal 126 may be permanently or removably attached to the headgear article 120. In one exemplary embodiment, the face seal 126 is attached, e.g., removably attached, to the lens frame 122*b*. Preferably, the face seal 126 is made of a soft material due to the need to put it in contact with a user's skin, such as a woven or non-woven material, e.g., fabric.

In an exemplary embodiment, the outer periphery 126*a* of the face seal 126 is constructed to be disposed at least in part under the user's chin. The face seal 126 may be at least partially elastic, so that it could move with the user's jaw when the user talks and fit securely about the user's face after being stretched. In a typical embodiment, the face seal 126 has an elastic member disposed along the periphery 126*a* of the face seal 126 and characterized by at least a certain degree of sealing effectiveness or integrity that reduces or minimizes the leakage of air into the breathing zone. For example, the face seal 126 may include an elastic band (not shown) that can be made from any suitable material, such as SPANDEX material or the like. Alternatively, the face seal 126 itself may have elastic properties.

The face seal 126 may include one or more openings in its bottom portion 126*b*. The openings allow the breathable air delivered to the head covering member to exit upon exhaling. In another exemplary embodiment, instead of the one or more openings, the bottom portion 126*b* may include relatively air permeable material that will allow air to escape. Other approaches for allowing air out of the respirator system 100 may be used with exemplary embodiments of the present disclosure.

The respirator system 100 further includes a clean air supply system 150 which includes an inlet 152 configured for connection to a source of clean air 170 and an outlet 154 (shown in FIG. 1C) disposed within the breathing zone, preferably proximate a user's face. In the exemplary embodiment shown in FIG. 1C, the clean air supply system 150 includes a duct 156, connecting the inlet 152 and the outlet 154. The clean air supply system may further include a diverter 155 disposed in the outlet 154 and configured to allow the user to alter the direction and/or amount of air flow into the breathing zone 104. A diverter 155 can be a moveable structure disposed adjacent the outlet 155 and that determines the flow direction of air exiting the outlet, dependent upon the position of the structure relative to the outlet. Thus, the outlet 154 may be adjustable between at least a first outlet configuration wherein the air flow from the outlet is directed in a first direction and at least a second outlet configuration wherein the air flow from the outlet is directed in a second, different direction.

The breathing zone seal 127 may be on one end permanently or removably attached to the head covering member 124, for example, adjacent the outlet 154, and on another end it may be permanently or removably attached to the headband 128*a*. The breathing zone seal 127 may be made from the same type of material as the face seal 126 or from another suitable material, such as foam.

The inlet 152 can be connected to the source of clean air 170 by a hose 160. The source of clean air may be an air exchange apparatus, which is an apparatus for providing a finite breathing zone volume around the head of a user in which air can be exchanged in conjunction with the user's breathing cycle.

One example of a respirator system utilizing an air exchange apparatus is a Powered Air Purifying Respirator" (PAPR), which is a powered system having a blower to force ambient air through air-purifying elements to an inlet 152 of the clean air supply system 150. However, the present disclosure is not limited thereto and may include any other suitable air supply system, including but not limited to negative pressure systems. Other exemplary air supply systems may include, without limitation, any suitable supplied air system or a compressed air system, such as a self contained breathing apparatus (SCBA).

The inlet opening 152 may be positioned in the back of the headgear article 120. An air inlet fluid coupling arrangement (not shown) may be connectable to the hose 160, which, in turn, may be connected to the clean air supply 170. In an exemplary embodiment, air that enters through the inlet opening 152 is allowed to pass into the breathing zone through the outlet 154 and circulate between the visor 122 and a user's face.

Figure 2A:
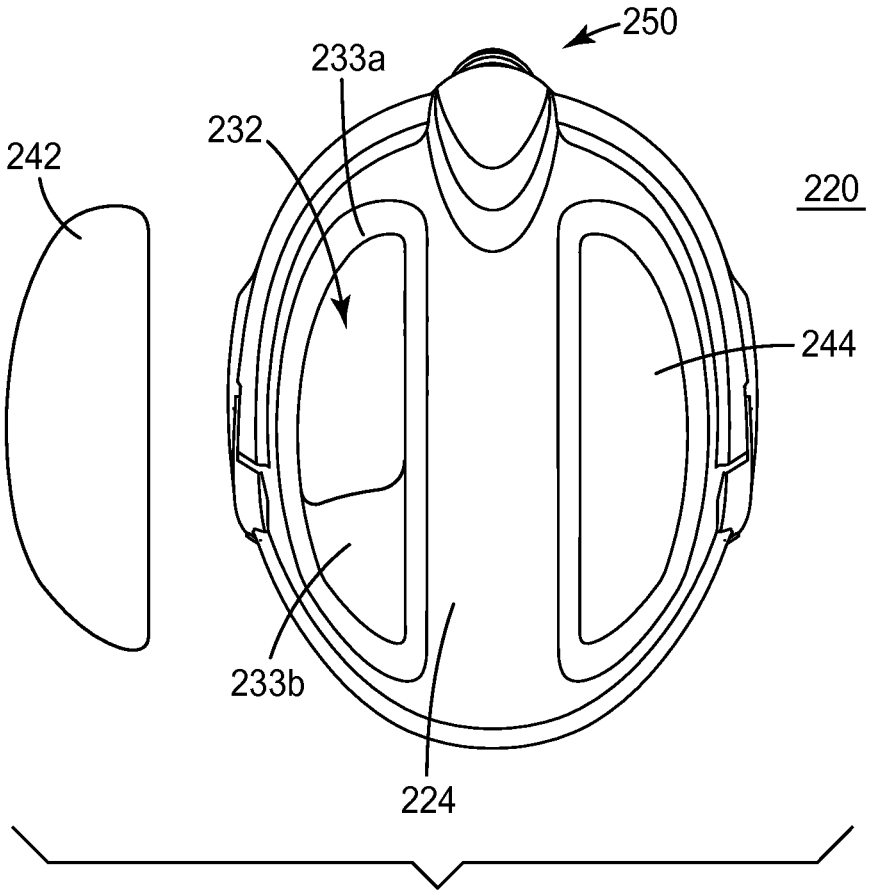
FIG. 2A shows schematically a top view of a headgear article according to an exemplary embodiment of the present disclosure.
Figure 2B:
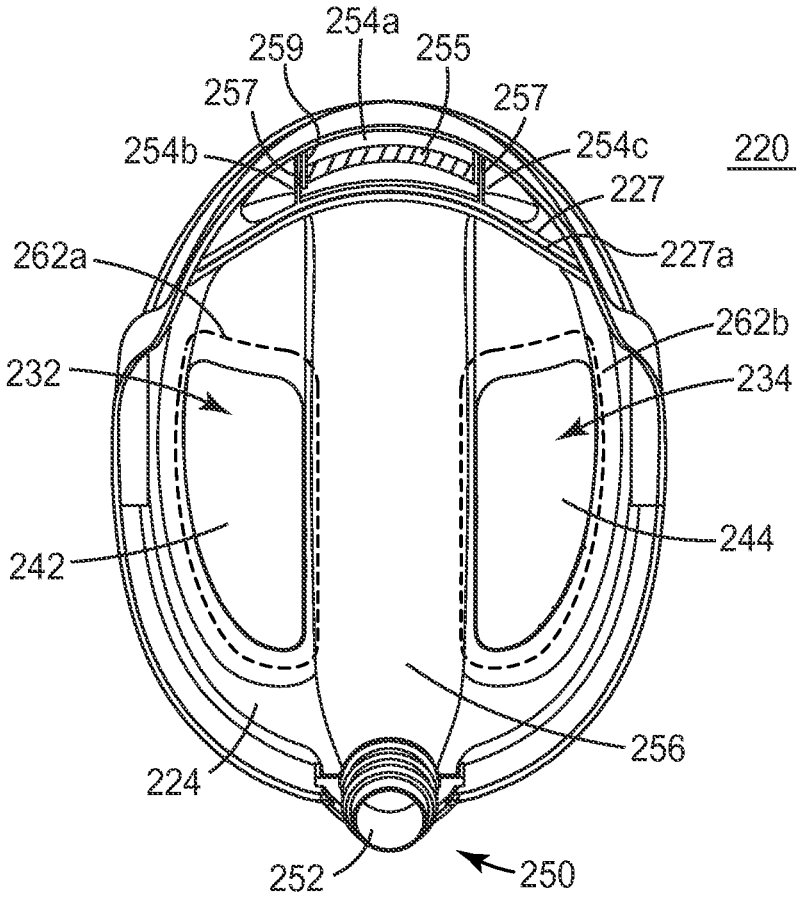
FIG. 2B shows schematically a bottom view of the headgear article shown in FIG. 2A.

FIGS. 2A and 2B show top and bottom views, respectively, of an exemplary headgear article 220 suitable for use with exemplary embodiments of the present disclosure. The headgear article includes a head covering member 224 having an outer shell with a first opening 232 and a second opening 234 formed therein. FIG. 2A shows an outer surface of the head covering member 224, while FIG. 2B shows an inner surface of the head covering member 224. When uncovered, the first and second openings 232 and 234 are configured to provide fluid communication between an interior zone defined by the headgear article 220 and environment outside the headgear article. A layer of filter material 262*a*, 262*b* may be disposed in one or both of the openings 232 and 234, such that the layer of filter material separates the interior zone from the environment outside the headgear article 220. The filter material may be attached to the head covering member 224 in any suitable manner.

A first panel 242 is disposed over the first opening 232 and removably attached to the head covering member 224. A second panel 244 is disposed over the second opening 234 and removably attached to the head covering member 224. FIG. 2A shows outer surfaces of the removable panels 242 and 244, while FIG. 2B shows their inner surfaces. FIG. 2A also shows the first panel 242 disengaged from the first opening 232, while the second panel 244 is shown as attached to the head covering member 224 to cover the second opening 234. FIG. 2B shows the first and second panels 242 and 242 attached to the head covering member 224 to cover the first and second openings 232 and 234.

In some exemplary embodiments, one or more removable panels 242 and 244 are configured to cover at least a portion of the outer surface of the head covering member 224. For example, in some exemplary embodiments, removable panels (e.g., 242) are configured to not only cover the opening but also at least the area of the outer surface of the head covering member 224 that is adjacent to an edge of the opening. In the exemplary embodiment shown, the removable panel 242 is configured to cover at least the area 233*a* of the outer surface of the head covering member 224 that is adjacent to an edge of the opening 232 and surrounds the opening 232. Preferably, the removable panel 242 is also configured to cover an additional area 233*b* of the outer surface of the head covering member 224. Nonetheless, in typical embodiments of the present disclosure, one or more removable panels are disposed such that at least a substantial portion of the outer surface of the panel is disposed to cover the opening.

In the exemplary embodiment shown in FIGS. 2A and 2B, a clean air supply system 250 is attached to the head covering member 224. In this exemplary embodiment, the clean air supply system includes an air duct 256 having an inlet 252 configured for connection to a source of clean air and an outlet disposed within the breathable zone. Preferably, when the headgear article 220 is supported on a user's head, the outlet is disposed in the proximity of the user's face. In one exemplary configuration, the air duct 256 is disposed between the first opening 232 and the second opening 234.

FIG. 2B shows an outlet that includes a central opening 254*a* and a pair of side openings 254*b* and 254*c*. The central opening 254*a* includes a diverter 255. Here, the diverter 255 is a panel that extends across the central opening 254*a* and is pivotally mounted adjacent thereto. The diverter 255 can be sized to completely cover the central opening 254*a*, in which case the flow of clean air is delivered into the breathing zone through the side openings 254*b* and 254*c*. The exemplary panel has side projections that are pivotally received within short walls 257 adjacent to the outlet and that separate the central opening 254*a* from the side openings 254*b* and 254*c*. The diverter 255 includes an actuator 259 projecting therefrom. Movement of the actuator 259 causes movement of the diverter 255. Depending upon the position of the diverter 255 relative to the central opening 254*a*, the direction of air flow exiting the central opening 254*a* is changed so that it may be directed in a first direction or in a second, different direction or another direction selected by a user.

FIG. 2B also illustrates an exemplary mechanism for attaching a breathing zone seal to the head covering member 220. The exemplary mechanism is a ridge 227 disposed in the frontal portion of the head covering member 220 and projecting from its inner surface. The ridge 227 is typically configured to aid in isolating the breathing zone of the headgear article from the remainder of the interior zone. For example, in one embodiment, the ridge 227 is configured as a wall projecting from the inner surface of the head covering member 220 that forms a part of the boundary between the breathing zone and the remainder of the interior zone. The exemplary ridge 227 may include a groove 227*a* for receiving and housing one end of the breathing zone seal. To facilitate attachment, the end of the breathing zone seal received in the groove may be shape-stable, for example, rubberized or made of a shape-stable polymeric material.

Figure 3A:
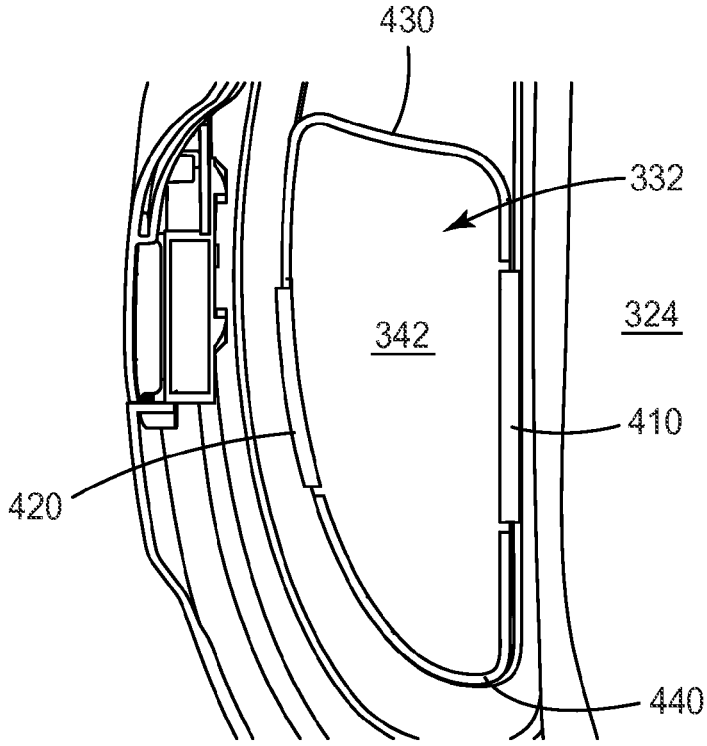
FIG. 3A shows schematically a bottom partial view of an exemplary head covering member demonstrating in detail an example of removable attachment of the panel to an edge of an opening.
Figure 3B:
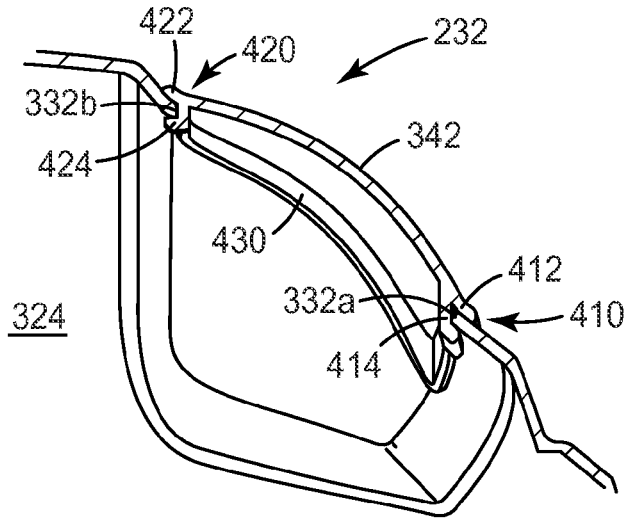
FIG. 3B shows schematically a bottom partial cross-sectional view of an exemplary head covering member demonstrating in detail an example of removable attachment of the panel to an edge of an opening.

FIGS. 3A and 3B show bottom partial views of an exemplary head covering member 324 demonstrating in detail removable attachment of the panel 342 to an edge (e.g., 332*a*, 332*b*) of the opening 332. FIG. 3A shows the panel 342 with two retaining members 410 and 420 configured to removably attach to an edge of the opening 332. Other exemplary embodiments of removable panels may have only one retaining member or more than two retaining members. In the illustrated exemplary embodiment, retaining members 410 and 420 are elongated latch members. The one or more latch members can be configured to form a snap-fit with an edge of the opening 332.

The latch members may be formed from a resilient material, such that they are capable of bending when a force is applied and then recovering its original shape when the force is released. One or more retaining members (e.g., 410, 420) can be formed integrally with the panel 342, such as by injection molding. FIG. 3B shows a cross-sectional view of a panel 342 removably attached to edges 332*a*, 332*b* of an opening 332 via retaining members 410, 420. Each exemplary retaining member 410, 420 includes a ledge 414, 424. In this exemplary embodiment, the ledge 414, 424 cooperates with an opposing peripheral edge of the panel 412,422 to removably retain an edge 332*a*, 332*b* of the opening 332 therebetween. Thus, at least one retaining member 410, 420 may be configured such that at least a portion thereof (e.g., a portion of the ledge 414, 424) is in contact with the inner surface of the head covering member 324. The at least one retaining member 410, 420 also may be configured such that at least a portion thereof (e.g., 412, 422) is in contact with the outer surface of the head covering member 324.

Other types and configurations of retaining members are within the scope of the present disclosure. For example, other suitable removable fastening systems include hook and loop systems, clips, screws, and adhesives, such as repositionable adhesives. In some exemplary embodiments, rotatable latches may be used as one or more retaining members. Rotatable latches typically utilize an arm rotatably mountable on the removable panel or the head covering member. The arm can be pivoted to extend across the edge of the opening and the removable panel to retain the panel to the head covering member. If the rotatable latch is mounted onto the removable panel, it may be rotated to extend under the lower surface of the head covering member and thereby retain the removable panel to the head covering member. The removable panel preferably further includes at least one locating feature to aid proper alignment of the removable panel with respect to the opening.

In an exemplary embodiment, the panel 342 includes one or more locating ridges 430, 440, which have shapes that mate with the periphery of the opening 332 to allow only one orientation in which the retaining members 410, 420 can interlock with the edges of the opening 332. Other types and configurations of locating features are also within the scope of the present disclosure, including but not limited to discrete protrusions or one or more tabs, slots, pegs and holes.

Thus, embodiments of the Respirator System Including Convertible Head Covering Member are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A respirator system comprising:

a headgear article defining an interior zone, the headgear article comprising a visor and a head covering member, the head covering member having first and second openings formed therein that provide fluid communication between the interior zone and environment outside the headgear article;

a breathing zone seal separating a breathing zone between the visor and a wearer's face from a remainder of the interior zone;

a first panel disposed over the first opening and a second panel disposed over the second opening, the first and second panels removably attached to the head covering member; and a clean air supply system comprising at least one duct disposed between the first and second openings and having an inlet configured for connection to a source of clean air and an outlet disposed within the interior zone.

2. The respirator system as recited in claim 1, further comprising a layer of filter material disposed in the first opening.

3. The respirator system as recited in claim 1, wherein the visor is pivotable with respect to the head covering member.

4. The respirator system as recited in claim 1, further comprising a source of clean air.

5. The respirator system as recited in claim 1, further comprising a face seal.

6. The respirator system as recited in claim 1, wherein the head covering member comprises an impact resistant material.

7. The respirator system as recited in claim 1, wherein the first panel comprises an impact resistant material.

8. The respirator system as recited in claim 1, wherein the first panel comprises at least one of: reflective material, a colored layer and a patterned layer.

9. A respirator system comprising:

a headgear article defining an interior zone and comprising a visor and a head covering member, the head covering member having first and second openings formed therein that provide fluid communication between the interior zone and environment outside the headgear article;

a breathing zone seal separating a breathing zone from a remainder of the interior zone;

a first panel disposed over the first opening and removably attached to the head covering member;

a second panel disposed over the second opening and removably attached to the head covering member; and an air duct disposed between the first and second openings, the air duct having an inlet configured for connection to a source of clean air and an outlet disposed within the interior zone.

10. The respirator system as recited in claim 9, further comprising a layer of filter material disposed in at least one of the first and second openings.

11. The respirator system as recited in claim 9, wherein the head covering member comprises an impact resistant material.

12. The respirator system as recited in claim 9, wherein the first and second panels comprise an impact resistant material.

13. The respirator system as recited in claim 9, wherein at least one of the first and second panels comprises at least one of: reflective material, a colored layer and a patterned layer.

14. A headgear article comprising:

a head covering member having first and second openings formed therein, the openings each having an edge, a first panel having an outer surface disposed such that a substantial portion of the outer surface is disposed over the first opening, the first panel further comprising at least one retaining member configured to removably attach to the edge of the first opening, a second panel having an outer surface disposed such that a substantial portion of the outer surface is disposed over the second opening, the second panel further comprising at least one retaining member configured to removably attach to the edge of the second opening, and at least one duct disposed between the first and second openings, wherein the headgear article defines an interior zone comprising a breathing zone between the headgear article and a wearer's face, a breathing zone seal separating the breathing zone from the remainder of the interior zone.

15. The headgear article of claim 14, wherein the head covering member has an outer surface and the first panel is disposed over at least a portion of the outer surface of the head covering member.

16. The headgear article of claim 15, wherein the head covering member has an inner surface and the at least one retaining member of the first panel is configured such that at least a portion of the at least one retaining member of the first panel is in contact with the inner surface.

17. The headgear article of claim 14, wherein the first panel comprises at least two elongated latch members.

18. The headgear article of claim 14, wherein the first panel further comprises at least one locating feature.

* * * * *